United States Patent [19]

Gagné

[11] 4,148,513

[45] Apr. 10, 1979

[54] DEVICE FOR REMOVAL OF ANIMAL DROPPINGS

[76] Inventor: Camille Gagné, 1206 Alexis Simard St., Ville de la Baie, Canada, G7B 2K4

[21] Appl. No.: 856,087

[22] Filed: Nov. 30, 1977

[51] Int. Cl.[2] ..... A01K 29/00; A47L 13/52

[52] U.S. Cl. ..... 294/55; 15/104.8; 15/257.1; 294/1 R

[58] Field of Search ..... 294/1 R, 19 R, 50.8, 294/50.9, 55; 15/104.8, 257.1, 257.2, 257.6, 257.7, 257.9

[56] References Cited

U.S. PATENT DOCUMENTS

| | | | |
|---|---|---|---|
| 405,828 | 6/1889 | Card | 15/104.8 |
| 783,657 | 2/1905 | Walter | 15/257.2 |
| 1,576,798 | 3/1926 | Spiegel | 294/50.9 |
| 1,669,302 | 5/1928 | Lanman | 15/104.8 |
| 3,431,008 | 3/1969 | Narita | 294/55 |
| 3,879,079 | 4/1975 | Nicholas | 294/19 R X |
| 3,977,715 | 8/1976 | Casci | 294/1 R X |

*Primary Examiner*—Johnny D. Cherry

[57] ABSTRACT

Device for the removal of animal droppings comprising a container open at the front, having an upstanding lip along its front bottom edge from which forwardly extends a curved ramp adapted to rest on the surface to be cleaned. A scraping and scooping member is pivotally mounted so as to scrape the animal droppings off the grass or the like in front of the container and scoop the same within the container along the ramp and past the upstanding lip. In its closed position, the combined scraping and scooping member seals the open end of the container. The container is carried from the upper end of an upstanding handle, rigidly secured thereto; a second handle is pivoted to the first one and to the combined scraping and scooping member to pivot the same between closed and open positions. A tension coil spring resiliently maintains the member in closed container-sealing position.

3 Claims, 3 Drawing Figures

DEVICE FOR REMOVAL OF ANIMAL DROPPINGS

It is a statistical fact that several hundred tons of domestic animal excrement are dropped daily in any large city. Pets, such as dogs and cats, are mostly responsible for this owing to a lack of restraint or training on the part of their owners. The problem is so serious in some areas, including those of small towns, that legislators have passed laws designed to reduce the misuse of public and private thoroughfares and property as outdoor animal toilets. Yet the widespread proliferation of droppings continues and removal is a more serious practical problem than prevention. Of course, animal droppings are not only odious on an aesthetic level but make poor fertilizer as well.

The prior art reveals that known devices for the removal of droppings fall into two basic classes: portable so-called animal toilets and various devices for disposing of excrement already deposited. The animal toilets present major inconveniences, requiring special pet training and the need to carry the toilet while out walking the pet. Of the various devices for removal of deposited excrement, the prior art teaches several but all have disadvantages.

For example, U.S. Pat. No. 3,052,214 teaches a "container means" which has a removable component that has to be periodically replaced. Such removable components are not always available and incur an extra expense. In addition, this particular device is unwieldy and could not easily be used by children who are frequently responsible for pets. U.S. Pat. No. 3,703,158 teaches a device having similar drawbacks and could not easily be used on a lawn surface. U.S. Pat. No. 3,757,737 reveals a relatively complicated device not suitable for inexpensive production.

In the Canadian art, other devices are shown, which also make use of disposable inserts or which are not specifically intentioned for the removal of pet excrement (for example dustpans).

Accordingly, it is an object of the present invention to provide a device for the removal of animal droppings, which is simple and inexpensive to construct.

It is another object of the invention to provide a device which may be easily operated by anyone, even children.

It is a further object of the present invention to provide a device which may be used to advantage on any surface especially a surface such as a sidewalk or a lawn where removal is frequently difficult.

These objects are accomplished by a device for dropping removal having a box container open at the front and equipped with a scoop; and two upright handles. One handle is rigid and immovable, being secured to the top of the box container. The other handle is pivoted and serves to pivot a battledore or combined scoop and scraper between a position closing the container and an opened position. During closing movement, the battledore scrapes the surface to be cleaned and pushes the droppings along a ramp and past a lip formed along the bottom edge of the container opening. The battledore sweeps the ramp during this closing movement. The lip prevents accidental discharge of the droppings from the container. The battledore, when closed, substantially seals the container against emission of bad odours. Preferably, a spring is provided to automatically close the battledore when the operating handle is released.

The above will be more clearly understood by the following elucidation and by referral to a preferred embodiment of the invention illustrated in the accompanying drawings, in which.

Figure 1:
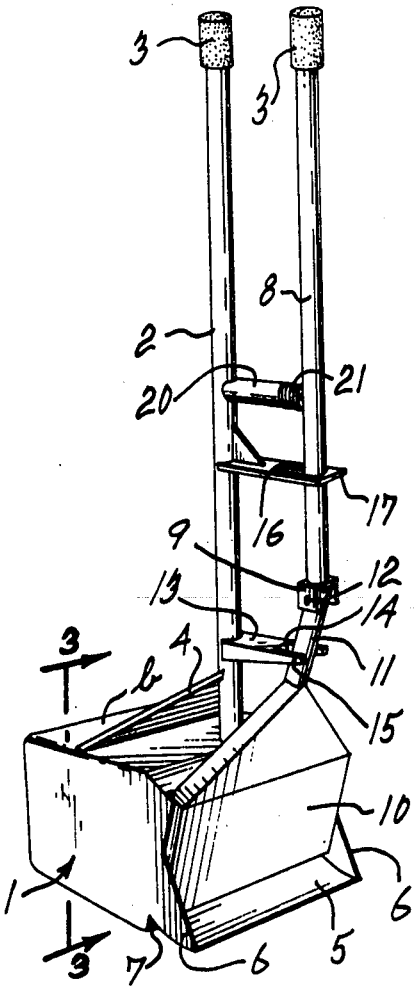
FIG. 1 is a perspective view of the device.

A box-shaped container 1 has a flat bottom 1*a*, a top wall 1*b*, a rear wall 1*c*, side walls 1*d*, and an open front. A rigid upright handle 2 having a grip 3 at its top end is secured to the top wall 1*b* of container 1 and is located in the middle of and toward the front of the top wall, thus balancing the container when it is picked up. A flat triangular brace 4 reinforces the handle 2. A ramp 5 having triangular sector sides 6 curves down from the upper edge of an upstanding lip 7, extending lengthwise along the front of bottom wall 1*a*, to a level flush with the bottom wall 1*a* of container 1, assuring good contact with the surface to be cleaned. Sector sides 6 are extensions of the respective side walls 1*d*.

A second operating handle 8 includes a grip 3 at its top end and a downward facing U bracket 9 attached to its lower end.

A battledore 10, flat and rectangular in its lower portion and triangular in its upper portion, has a lateral flange 18 extending rearwardly on each of the two sides of the rectangular lower portion and a flange 19 extending rearwardly from the bottom edge of the lower rectangular portion. An arm 11 projects upwardly from the apex of the triangular portion of battledore 10. The upper end of arm 11 pivotally attaches to bracket 9 by means of a transverse pivot pin 12 secured to bracket 9 and extending through arm 11. Free edge 19' of flange 19 of battledore 10 sweeps the surface on which container 1 rests and then the top face of curved ramp 5 during closing pivoting movement of battledore 10.

Handle 2 includes a horizontal and frontwardly extending arm 13 provided with a notch 14 at its end which is wide and deep enough to receive the arm 11 of battledore 10. A second transverse pivot pin 15 is secured to arm 13 and extends through arm 11.

Operating handle 8 passes freely through a slot 16 provided in a horizontal frontwardly extending slat 17 secured to handle 2 above the elbow joint formed by pivot 12. Immediately above slat 17, handle 2 is further provided with a horizontal frontwardly extending cylinder 20. A tension coil spring 21 attaches at one end to handle 2 inside cylinder 20 and at its other end to operating handle 8.

Figure 2:
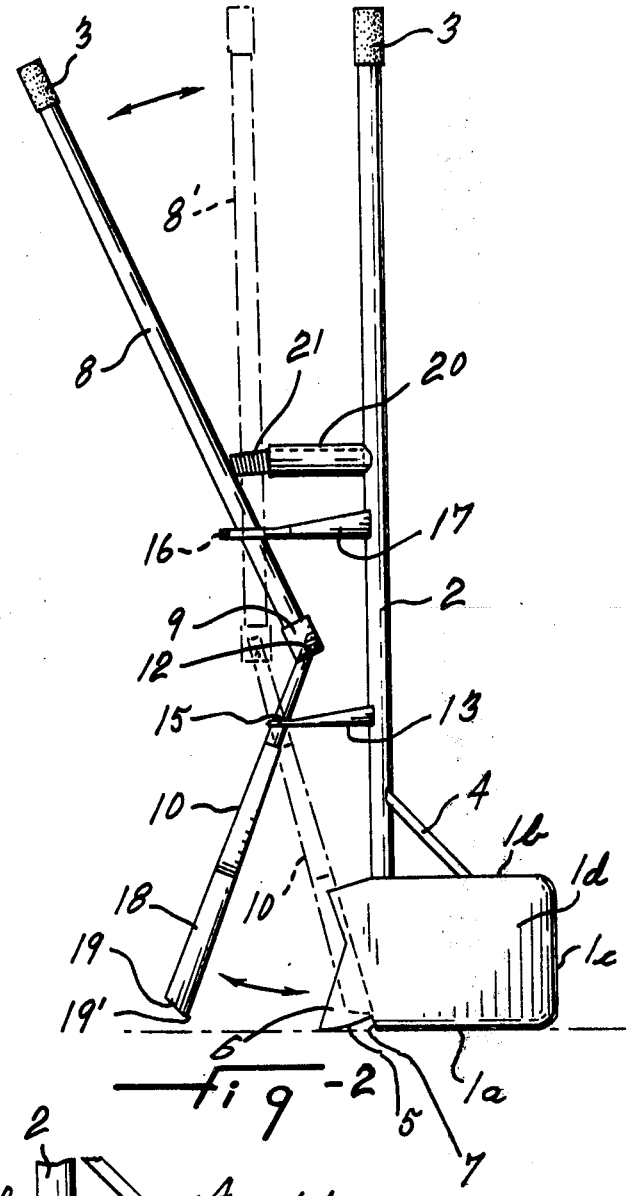
FIG. 2 is a side elevation of the device showing the battledore in open position.

When operating handle 8 is pushed forward, as shown in FIG. 2, the following pivoting actions occur. Handle 8 pivots about elbow joint 12 and about slat 17. Battledore 10 swings outward, being pivoted by inwardly moving elbow joint 12 and pivoting about pivot pin 15. Slot 16 is enough to accommodate operating handle 8 when it is in an inclined position. Also, slot 16 is wide enough to allow longitudinal sliding movement of handle 8 during its pivoting movement. Tension coil spring 21 acts as a biasing means to return handle 8 and battledore 10 to an upright and closed position respectively when the grip 3 of handle 8 is released.

Figure 3:
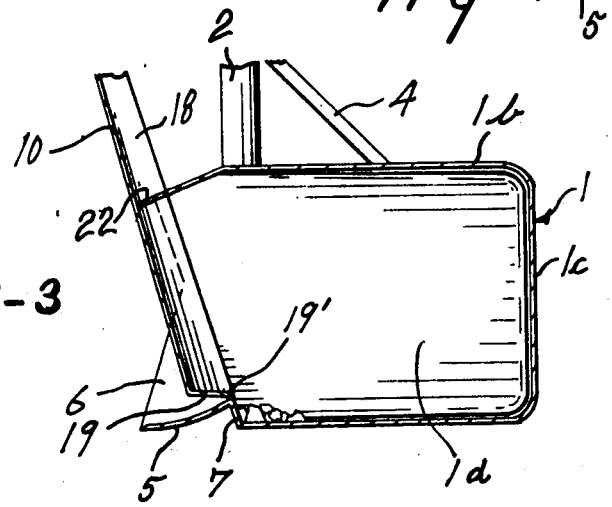
FIG. 3 is a sectional view of the box container taken along line 3—3 of FIG. 1 and showing the battledore in closed position.

It is to be noted that the center of curvature of ramp 5 coincides with pivot pin 15, that is the pivot of battledore 10, and that this pivot is located a little forwardly of ramp 5, so that edge 19' of battledore 10 will scrape the stuck droppings off the surface to be cleaned before propelling the same along ramp 5 and into container 1 past the upstanding lip 7. When battledore 10 is in closed position, as shown in FIG. 3, a sealing contact is obtained because lateral flanges 18 fit the inside faces of the side walls 1*d* of the container, because free edge 19' fits ramp 5 and because the free edge 22 of top wall 1*b* of the box contacts battledore 10, there being notches in said top wall 1*b*, adjacent side walls 1*d*, to accommodate side flanges 18.

I claim:

1. A device for dropping removal comprising a container having a bottom wall, a top wall, side walls, a rear wall and open at the front, an upstanding lip along the front edge of said bottom wall, a ramp downwardly forwardly extending from the top edge of said lip, a first handle rigidly secured to, and upstanding from, the top wall of said container, a battledore pivotally carried by said first handle for movement between a container-opening position and a container-closing position, said battledore having a lower edge adapted to sweep said ramp during closing movement, a second handle pivotally carried by said first handle and pivoted to said battledore for opening and closing said battledore, the pivot axis of said battledore on said first handle being located above and slightly forwardly of said ramp, the free lower edge of said battledore adapted to first scrape droppings from the surface to be cleaned, then scoop the same along said ramp past said lip during closing movement of said battledore, said ramp being transversely curved and having its center of curvature coinciding with the pivot axis of said battedore to said first handle, and with said battledore having a bottom flange and side flanges, said side flanges being in slidable contact with the side walls of said container in the closed position of said battledore.

2. A device for dropping removal comprising a container having a bottom wall, a top wall, side walls, a rear wall and open at the front, an upstanding lip along the front edge of said bottom wall, a ramp downwardly forwardly extending from the top edge of said lip, a first handle rigidly secured to, and upstanding from, the top wall of said container, a battledore pivotally carried by said first handle for movement between a container-opening position and a container-closing position, said battledore having a lower edge adapted to sweep said ramp during closing movement, a second handle pivotally carried by said first handle and pivoted to said battledore for opening and closing said battledore, the pivot axis of said battledore on said first handle being located above and slightly forwardly of said ramp, the free lower edge of said battledore adapted to first scrape droppings from the surface to be cleaned, then scoop the same along said ramp past said lip during closing movement of said battledore, said ramp being transversely curved and having its center of curvature coinciding with the pivot axis of said battledore to said first handle, and said battledore extending upwardly past its pivot axis on said first handle, said second handle being pivoted to the upper end of said battledore at its lower end, said first handle carrying a slat having a slot through which said second handle freely extends, said slat located above the pivot connection of said second handle to said battledore, said second handle being pivotable, and longitudinally displaceable in said slot of said slat.

3. A device as claimed in claim 2, further including a tension spring attached to said first and second handles above said slat and resiliently maintaining said first and second handles in substantially parallel position and said battledore in closed position.

* * * * *